US008618386B2

(12) United States Patent
Sophos

(10) Patent No.: US 8,618,386 B2
(45) Date of Patent: Dec. 31, 2013

(54) ADJUSTABLE GUITAR RAMP

(76) Inventor: Christopher Sophos, Danbury, CT (US)

( * ) Notice: Subject to any disclaimer, the term of this patent is extended or adjusted under 35 U.S.C. 154(b) by 106 days.

(21) Appl. No.: 13/211,391

(22) Filed: Aug. 17, 2011

(65) Prior Publication Data

US 2013/0042742 A1 Feb. 21, 2013

(51) Int. Cl.
*G10D 3/00* (2006.01)

(52) U.S. Cl.
USPC ..... 84/290

(58) Field of Classification Search
USPC ..... 84/290, 298, 312 R, 307
See application file for complete search history.

(56) References Cited

U.S. PATENT DOCUMENTS

| | | | | |
|---|---|---|---|---|
| 4,334,454 | A | 6/1982 | Wall | |
| 4,433,605 | A | 2/1984 | Matsui | |
| 4,867,031 | A | 9/1989 | Fender | |
| 5,492,044 | A | 2/1996 | Sperzel | |
| 6,124,536 | A * | 9/2000 | Hoshino | 84/298 |
| 6,369,305 | B1 | 4/2002 | Powers et al. | |
| 6,870,083 | B2 | 3/2005 | Turner | |
| 7,375,276 | B2 | 5/2008 | Kanayama et al. | |
| 2007/0234872 | A1 | 10/2007 | Cody | |
| 2008/0034940 | A1 | 2/2008 | Medas | |
| 2009/0205477 | A1 * | 8/2009 | Stadler | 84/299 |
| 2010/0037746 | A1 | 2/2010 | Medas | |

* cited by examiner

*Primary Examiner* — Kimberly Lockett
(74) *Attorney, Agent, or Firm* — Lackenbach Siegel, LLP

(57) ABSTRACT

A stringed instrument and a ramp which including a flexible plate and a plurality of rotatable elements or screws for flexing the plate to adjust the curvature of the plate with respect to the strings with the rotatable elements or screws rotatably disposed in the flexible plate for flexing the plate to adjust the curvature of the plate along at least two axes with two spaced screws operably disposed in the plate for flexing the plate in relation to the adjacent string, so that the distance between each string and the flexible plate is adjusted to the desired specifications of the musician.

25 Claims, 3 Drawing Sheets

ADJUSTABLE GUITAR RAMP

FIELD OF THE INVENTION

This invention relates to stringed instruments. Specifically, this invention relates to devices for stringed instruments, particularly including guitars.

BACKGROUND AND DISCUSSION OF THE PRIOR ART

Certain stringed instruments, particularly including guitars, and more particularly bass guitars require devices to improve the playability and to accommodate the fingers and specifications of the musician. One such device is a ramp. Ramps are generally fixed to the upper surface of an instrument, particularly a bass guitar. Ramps are generally customized by the guitar manufacturer to accommodate the fingers and specifications of the musician purchasing the bass guitar. One such ramp is referred to as the "Willis" ramp. See garywillis website.

The art desired a ramp that would better accommodate a musician's particular fingers and specifications, and yet be readily fitted to the instrument.

It is therefore a principal object of the present invention to provide an improved ramp for a stringed instrument to provide readily customized playability.

It is a further object of the present invention to provide a ramp as aforesaid that is readily adjusted to accommodate the fingers and specifications of the musician.

It is a further object of the present invention to provide a ramp as aforesaid which is readily adjustable by the musician.

It is still a further object of the present invention to provide a ramp that is readily retrofitted to the stringed instrument.

It is still a further object of the present invention to provide a ramp which is readily and economically manufactured, of practical design and construction, and readily adjustable by a musician to provide customized playability.

SUMMARY OF THE INVENTION

The ramp for and in combination with a stringed instrument includes a flexible plate and a plurality of means for flexing the plate so as to flexibly change the curvature of the plate and in turn provide the desired distance between the ramp upper surface and each respective string. The plurality of means for flexing the plate adjusts the curvature of the plate along at least two axes. The adjustably curved plate provides the desired distance between a particular string and the upper surface of the ramp so as to customize the instrument to the fingers and desired playability of the musician.

The plurality of means for flexing the plate are operably disposed in the flexible plate, and include threaded members or screws in parallel or collinear disposition with and adjacent one of the strings. The screws are tightened and loosened to flex the plate to the desired radii and arcuate curvatures.

The flexible plate is mounted on a non-flexible second plate, and the screws are disposed through the flexible plate into the second plate. The bottom surface of the second plate is provided with a double-faced adhesive element or tape for securely retaining the ramp on the instrument during playing of the instrument.

In one embodiment, the flexible plate extends along the instrument such as a bass guitar, and covers the proximately and distally disposed pick-ups.

In a further embodiment, the flexible plate extends downwardly at at least one side towards the upper surface of the instrument, such as a bass guitar, to provide a thumb guard.

BRIEF DESCRIPTION OF A DRAWING

DESCRIPTION OF THE INVENTION

Figure 1:
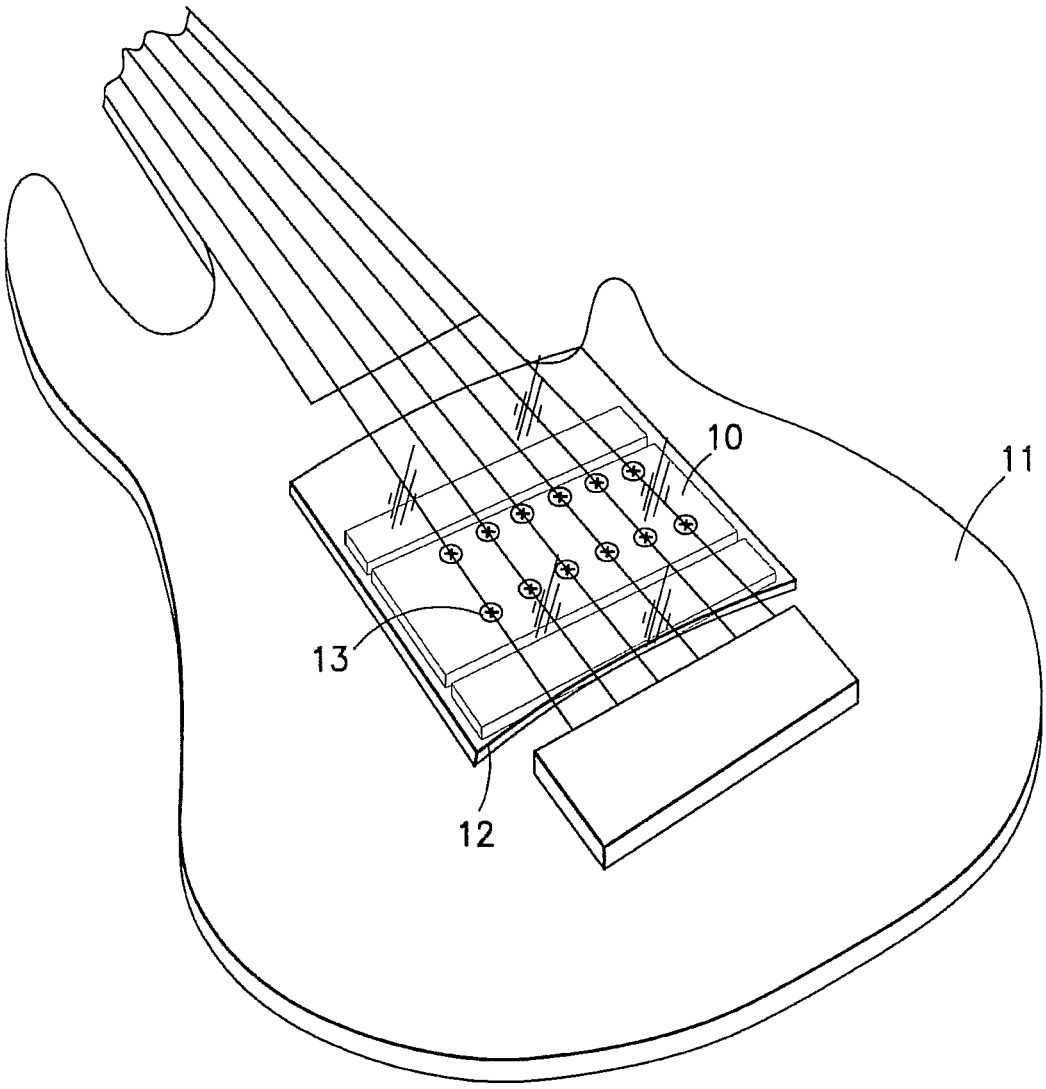
FIG. 1 is a top perspective view of a bass guitar with the ramp of the present invention.
Figure 2:
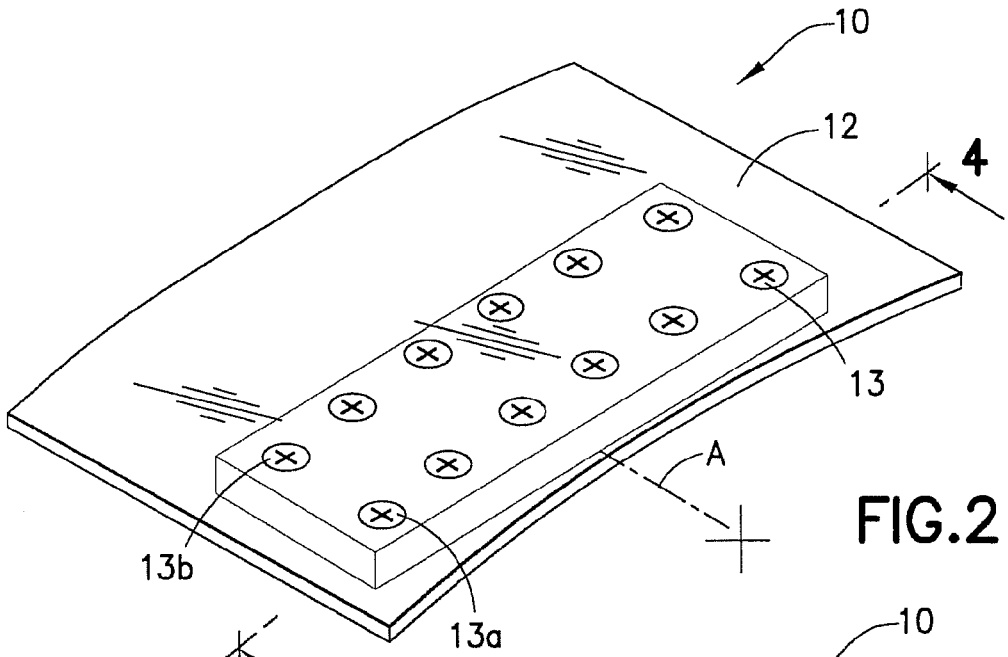
FIG. 2 is a top perspective view of the present invention with a transverse curvature.
Figure 3:
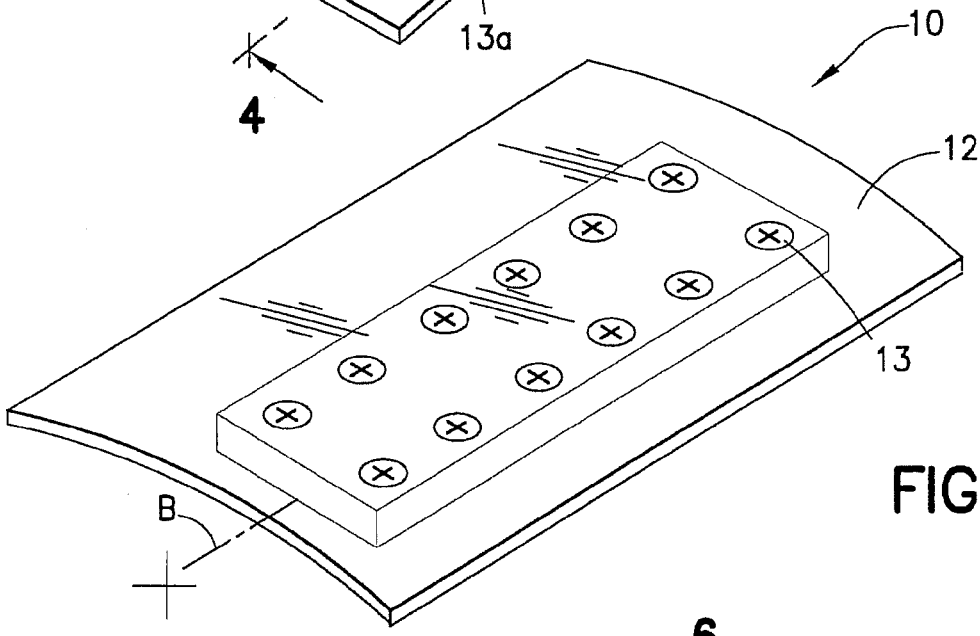
FIG. 3 is a top perspective view of the present invention with a longitudinal curvature.
Figure 4:
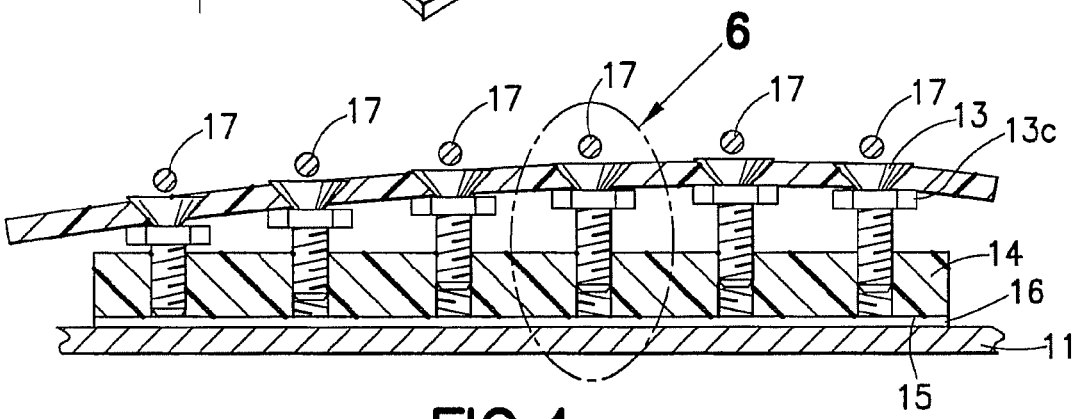
FIG. 4 is a sectional view taken along line 4-4 of FIG. 2.
Figure 5:
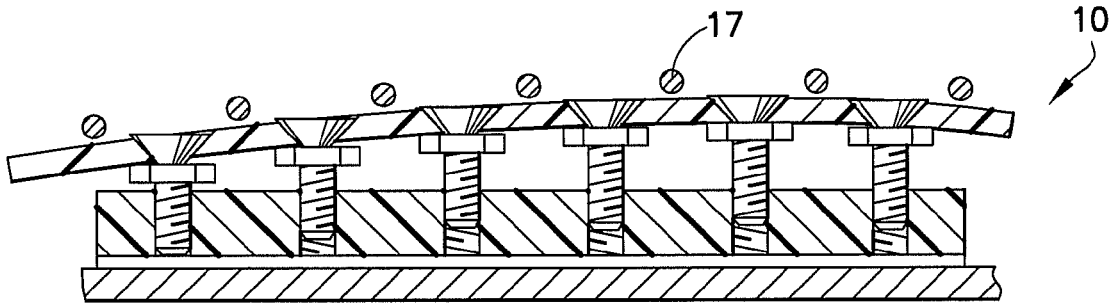
FIG. 5 is an alternate view of FIG. 4 showing the strings non-aligned with the screws.
Figure 6:
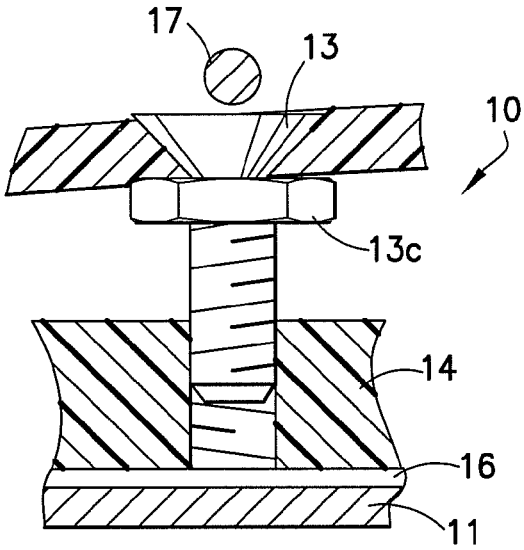
FIG. 6 is an alternative view taken from FIG. 4.

The term "ramp" is used hereinbefore and herein refers to a ramp that is disposed between pick-ups, as well as a pick-up ramp that is disposed above a particular pick-up.

Referring to the FIGS., there is shown ramp 10 and string instrument namely, bass guitar 11. Ramp 10 includes a flexible plate 12, and a plurality of screws 13, with nuts 13*c* retain screws 13 to plate 12. Screws 13 are operably disposed through flexible plate 12 and extend downwardly into second or non-flexible plate 14. Bottom surface 15 of plate 14 is provided with a double-faced adhesive member or tape 16. Tape 16 securely holds ramp 10 in place during the playing of bass guitar 11. Screws 13 include pairs of screws e.g. 13*a* and 13*b* which are in parallel disposition with strings 17, for purposes hereinafter appearing. Each string is provided with a like respective pair of screws for purposes hereinafter appearing.

In the aforementioned manner of construction, the tightening or loosening of screws 13, flexes plate 12 and alters the curvature of plate 12 along two axes A and B; i.e. parallel and transverse to the strings. This construction permits the musician to retrofit ramp 10 to bass guitar 11, and upper plate 12, and in turn, the distance between each respective string and upper surface 20 of flexible plate 12, to the desired feel and playability specifications of the musician.

Figure 7:
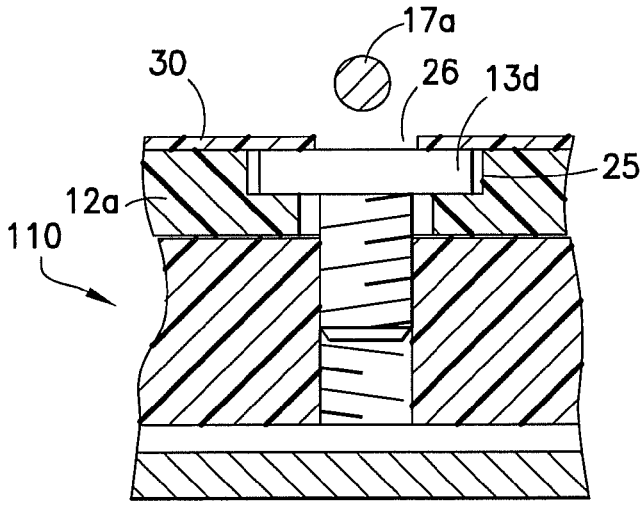
FIG. 7 is an alternate construction as show in FIG. 6

Referring to FIG. 7, there is shown an alternate embodiment of the ramp 110. Ramp 110 has a flat-head screw 13*d* disposed in recess 25. A plastic annular cover piece 30 is thermoplastically bonded to flexible sheet 12*a*. The screw head is then accessed through circular orifice 26 in cover piece 30. String 17*a* is aligned with screw 13*d*.

Flexible plate 12 may be of any suitable material, particularly including plastic materials, and preferably ABS plastics. Non-flexible plate 14 may be of suitable material, particularly wood or hard durable resinous plastic material.

It is to be understood that plate 12 may be curved downward at one longitudinal edge to provide a thumb rest (not shown).

The afore-described merely illustrates an embodiment of the invention and is not intended or to be construed as limiting of the invention which is defined by the adjoined claims.

What is claimed is:

1. A ramp for a stringed instrument, said ramp comprises; a flexible plate; a second plate, wherein the first plate is flexible and disposed above the second plate, and a plurality of rotatable elements rotably interacting through the first plate to the second plate for flexing the first plate, said plurality of elements comprises a first plurality and second plurality, said first and second pluralities being spacedly disposed; wherein with rotation of the rotatable elements a curvature in the first plate is adjusted; whereby with the ramp disposed on the stringed instrument between the strings and the upper surface of the instrument, the distance between each string and the first plate upper surface is adjusted.

2. The ramp of claim 1, wherein the rotatable elements comprise threaded elements.

3. The ramp of claim 2, wherein the number of threaded elements in each of the first and second pluralities of threaded elements are in the same number as the number of strings of the stringed instrument.

4. The stringed instrument of claim 1, wherein the plurality of means for flexing the plate adjusts the curvature of the plate along at least two axes.

5. The string instrument of claim 4, wherein the stringed instrument comprises a bass guitar, said bass guitar comprises two spaced pick-ups, and wherein the flexible plate is disposed between the pick-up and extends over each pick-up.

6. The string instrument of claim 4, wherein each said means for flexing the plate comprises two spaced threaded members operably spacedly disposed in the plate for flexing the plate in relation to an adjacent string.

7. The string instrument of claim 4, comprising the two spaced threaded rotatable elements in parallel disposition with an adjacent string.

8. The string instrument of claim 4, wherein the flexible plate comprises at least one side extending downwardly towards the surface to provide a thumb rest.

9. The string instrument of claim 1, said ramp further comprises a second plate disposed below the first plate and wherein the plurality of means for flexing the flexible plate extends into the second plate, and further comprising adhesive means for bonding the bottom surface of the second plate and the stringed instrument surface.

10. The string instrument of claim 6, wherein the adhesive means comprises double-faced adhesive tape.

11. The string instrument of claim 2, wherein the stringed instrument comprises a guitar.

12. The string instrument of claim 8, wherein the guitar comprises a bass guitar.

13. The string instrument of claim 2, wherein the flexible plate is a one-piece plastic member.

14. A stringed instrument comprising a surface and a plurality of strings under tension disposed above the surface, and a ramp disposed between the strings and instrument surface, said ramp comprises; a flexible plate, and a plurality of means for flexing the plate to adjust the curvature of the plate with respect to the strings, wherein the means for flexing the plate adjusts a curvature in the flexible plate along at least two axes, and wherein each said means for flexing the plate comprising at least two spaced threaded members operably disposed in the plate for flexing the plate in relation to one of the strings, whereby the distance between each string and the upper surface of the flexible plate is adjusted.

15. A ramp for operable disposition on a stringed instrument comprising: a flexible plate, and a plurality of means disposed in the plate for flexing the plate in relation to each string of the stringed instrument, whereby the distance between each string and the flexible plate is adjusted.

16. The ramp of claim 15, wherein the means for flexing the plate adjusts a curvature in the plate is positionable between the pick-up and along at least two axes.

17. The ramp of claim 16, further comprising means for adhesively removably holding the ramp on the stringed instrument.

18. The ramp of claim 16, wherein each said means for flexing the plate comprising at least two spaced threaded members operably disposed in the plate for flexing the plate in relation to an adjacent string.

19. The ramp of claim 16, wherein the two spaced threaded members are co-aligned and in parallel disposition with the adjacent string.

20. The ramp of claim 16, wherein the plate extends downwardly from the flexible plate towards the upper surface of the stringed instrument.

21. The ramp of claim 16, further comprising a second plate disposed below the first plate, and wherein the plurality of means for flexing the flexible plate extends into the second plate, and further comprising means for adhesively bonding the bottom surface of the second plate to the stringed instrument surface.

22. The ramp of claim 21, wherein the adhesive means comprises double-faced adhesive tape.

23. The ramp of claim 21, wherein the curvature of the first plate is adjusted along two axes.

24. The ramp of claim 23, wherein the curvature is adjusted to customize each string of the stringed instrument.

25. The ramp of claim 21, wherein the first plate extends in two directions away from the second plate.

* * * * *